US010118800B2

(12) United States Patent
Siikonen et al.

(10) Patent No.: US 10,118,800 B2
(45) Date of Patent: Nov. 6, 2018

(54) METHOD AND ARRANGEMENT FOR CLOSING DOORS OF AN ELEVATOR OF A MULTI-CAR ELEVATOR SHAFT SYSTEM

(71) Applicants: Marja-Liisa Siikonen, Helsinki (FI); Janne Sorsa, Helsinki (FI); Pentti Alasentie, Espoo (FI)

(72) Inventors: Marja-Liisa Siikonen, Helsinki (FI); Janne Sorsa, Helsinki (FI); Pentti Alasentie, Espoo (FI)

(73) Assignee: KONE CORPORATION, Helsinki (FI)

( * ) Notice: Subject to any disclaimer, the term of this patent is extended or adjusted under 35 U.S.C. 154(b) by 0 days.

(21) Appl. No.: 14/826,903

(22) Filed: Aug. 14, 2015

(65) Prior Publication Data

US 2016/0052748 A1 Feb. 25, 2016

(30) Foreign Application Priority Data

Aug. 22, 2014 (FI) ..... 20145736

(51) Int. Cl.
*B66B 1/34* (2006.01)
*B66B 13/12* (2006.01)
(Continued)

(52) U.S. Cl.
CPC ..... *B66B 13/12* (2013.01); *B66B 5/027* (2013.01); *B66B 13/146* (2013.01); *B66B 9/003* (2013.01)

(58) Field of Classification Search
CPC ..... B66B 1/2433; B66B 13/12; B66B 13/125; B66B 13/146; B66B 5/027; B66B 9/003
(Continued)

(56) References Cited

U.S. PATENT DOCUMENTS 5,404,969 A * 4/1995 Hoefsloot ..... B66B 13/303 187/326
5,419,414 A * 5/1995 Sakita ..... B66B 1/2433 187/247
(Continued)

FOREIGN PATENT DOCUMENTS

DE 3803317 A1 * 8/1988 ..... B66B 13/303
EP 0544541 A2 6/1993
(Continued)

OTHER PUBLICATIONS

AIPN, Machine Translation, JP 2007-137545A, Jul. 20, 2016, pp. 1-25.*
(Continued)

*Primary Examiner* — Anthony Salata
(74) *Attorney, Agent, or Firm* — Harness, Dickey & Pierce, P.L.C.

(57) ABSTRACT

The invention relates to a method and arrangement for closing doors of an elevator that comprises at least an elevator shaft, a car running along guide rails, in the shaft and equipped with a car door, landing doors at each landing floor, a hoisting machinery, a necessary roping system and shaft equipment, and a control system for controlling the activities of the elevator. According to traffic situations controlled by the control system of the elevator the door open time of the car doors and landing doors is reduced by speeding up the closure of the doors, and at the same time the passengers are informed about the speed-up.

6 Claims, 3 Drawing Sheets

(51) Int. Cl.
*B66B 5/02* (2006.01)
*B66B 13/14* (2006.01)
*B66B 9/00* (2006.01)

(58) Field of Classification Search
USPC ..... 187/249, 247, 313, 316, 317, 380–388, 187/391, 392, 394; 49/26, 28
See application file for complete search history.

(56) References Cited

U.S. PATENT DOCUMENTS

| | | | | | |
|---|---|---|---|---|---|
| 5,785,153 | A * | 7/1998 | Powell | B66B 1/18 | 187/249 |
| 5,877,462 | A * | 3/1999 | Chenais | B66B 5/0031 | 187/249 |
| 7,114,594 | B2 * | 10/2006 | Rossignol | B66B 11/002 | 187/276 |
| 7,650,966 | B2 * | 1/2010 | Sansevero | B66B 1/2466 | 187/249 |
| 8,136,635 | B2 * | 3/2012 | Christy | B66B 5/0031 | 187/249 |
| 8,297,409 | B2 * | 10/2012 | Hsu | B66B 1/2433 | 187/247 |
| 8,434,599 | B2 * | 5/2013 | Wang | B66B 5/0031 | 187/249 |
| 8,540,057 | B2 * | 9/2013 | Schuster | B66B 1/34 | 187/247 |
| 8,863,910 | B2 * | 10/2014 | Sonnenmoser | B66B 13/22 | 187/249 |
| 9,708,155 | B2 * | 7/2017 | Tokura | B66B 5/0031 | |
| 2004/0108171 | A1 * | 6/2004 | De Coi | B66B 13/26 | 187/316 |
| 2005/0082121 | A1 * | 4/2005 | Deplazes | B66B 5/0031 | 187/313 |
| 2005/0087402 | A1 * | 4/2005 | Haegi | B66B 1/2458 | 187/383 |
| 2005/0133313 | A1 | 6/2005 | Rossignol et al. | | |
| 2007/0089935 | A1 * | 4/2007 | Hikita | B66B 1/2433 | 187/249 |
| 2008/0263964 | A1 * | 10/2008 | Ludwig | B66B 13/146 | 49/506 |
| 2011/0272220 | A1 | 11/2011 | Kostka et al. | | |
| 2016/0052748 | A1 * | 2/2016 | Siikonen | B66B 5/027 | 187/314 |

FOREIGN PATENT DOCUMENTS

| | | | |
|---|---|---|---|
| EP | 0548505 | A1 | 6/1993 |
| EP | 0814047 | A1 | 12/1997 |
| EP | 2311769 | A2 | 4/2011 |
| JP | H04361968 | A | 12/1992 |
| JP | H0820481 | A | 1/1996 |
| JP | 2002068644 | A | 3/2002 |
| JP | 2007001758 | A | 1/2007 |
| JP | 2007084236 | A | 4/2007 |
| JP | 2007137545 | A | 6/2007 |
| JP | 2010047386 | A | 3/2010 |
| JP | 2013159451 | A | 8/2013 |
| WO | WO-2006088457 | A1 | 8/2006 |
| WO | WO-2008/079147 | A1 | 7/2008 |

OTHER PUBLICATIONS

Office Action for Corresponding Japanese Patent Application No. 2015-163530 dated Nov. 10, 2015.
Combined Search and Examination Report dated Dec. 10, 2015 issued in corresponding GB Application No. 1512441.5.
Finnish Search Report for FI 20145736 dated Mar. 23, 2015.
Office Action for Corresponding Chinese Patent Application No. 201510507543.7 dated Oct. 10, 2017.
Office Action for corresponding German Application No. 102015111754.1 dated Jun. 15, 2018.

* cited by examiner

METHOD AND ARRANGEMENT FOR CLOSING DOORS OF AN ELEVATOR OF A MULTI-CAR ELEVATOR SHAFT SYSTEM

CROSS-REFERENCE TO RELATED APPLICATIONS

This application claims priority to Finland Patent Application No. 20145736 filed on Aug. 22, 2014, the entire contents of which are incorporated herein by reference.

SUMMARY

At least some example embodiments relate to a method for closing doors of an elevator that comprises at least an elevator shaft, a car running along guide rails, in the shaft and equipped with a car door, landing doors at each landing floor, a hoisting machinery, a necessary roping system and shaft equipment, and a control system for controlling the activities of the elevator, and an arrangement for closing doors of an elevator that comprises at least an elevator shaft, a car running along guide rails, in the shaft and equipped with a car door, landing doors at each landing floor, a hoisting machinery, a necessary roping system and shaft equipment, and a control system for controlling the activities of the elevator.

The solution according to the invention is suitable for all kinds of elevator systems where automatic doors are used, and specially the solution according to the invention suits for using in multi-car elevator shaft systems. The term multi-car elevator shaft system in this connection means an elevator system where two or more elevator cars are running independently from each other in one elevator shaft. The system can comprise only one shaft or two shafts. In case of one shaft each elevator car can be moved independently, so they can be stopped on a floor, moved downwards or moved upwards. The control system of the elevator keeps track of the locations and motions of the cars so that no collisions can take place. In case of two shafts two or more elevator cars move always in one direction in one elevator shaft. For example the elevator cars move downwards in the first shaft of the system and upwards in the second shaft of the system. The elevator cars change the shaft, for example horizontally, at the bottom floor and at the top floor.

However, the multi-car elevator shaft systems mentioned above may encounter problems when an elevator car stopped at a floor keeps its doors open to long and the next car is approaching the floor where the car with the door open stays. The reason behind too long door open times can be passengers who keep the doors open too long, or a malfunction of the door operator. In those cases one elevator car may stop the operation of the whole shaft or the whole elevator system and the cars coming behind the stuck one need to wait for the route clearance. Another type of problem occurs with a malfunction of the door operator when the doors stick in an open position. In the situation like this it is very dangerous to move the elevator car. If the landing door sticks in an open position and the car is moved away there is a danger of people falling into the elevator shaft through the open doorway. And if only the car door sticks in an open position and the car is moved there is a danger of passengers being injured if they sway outwards through the open doorway.

The object of the present invention is to eliminate the drawbacks described above and to achieve a reliable, well functioning and safe method and arrangement in an elevator system for closing doors of the elevator. Another object of the present invention is to achieve a method and arrangement in an elevator system to improve the capacity of the elevator and the overall ride comfort of the elevator system. Yet another object of the present invention is to adopt the same method and arrangement for closing doors in a multi-car elevator shaft system.

The method for closing doors of the elevator according to the invention includes, for example, according to situations, the control system adjusting a door open time of the car doors and landing doors. Correspondingly, the arrangement for closing doors of the elevator according to the invention includes, for example, means for monitoring the door open times of the car doors and landing doors and speeding up the closure of said doors according to traffic situations of the elevator controlled by the control system of the elevator.

The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. Likewise the different details presented in connection with each embodiment can also be applied in other embodiments. In addition it can be stated that at least some of the subordinate claims can, in at least some situations, be deemed to be inventive in their own right.

The solution according to the invention is characterized by the fact that a shortening of door open times is done, for example by speeding up the closure time of the doors, and at the same time the passengers are informed about the speed-up, for instance with a nudging sound. Passengers who do not react to the speed-up information quickly enough have to wait for the next suitable car.

In a more generic sense the car traffic is maintained by controlling door open times so that the cars do not disturb each other. For that purpose also the speed of the second car coming after the first car can adjusted slower if that kind of need exists.

The method and arrangement according to the invention, shortly the solution according to the invention has the advantage among other things that it makes it possible to speed up the transportation function of the elevator. Another advantage is that it makes it possible to achieve a reliable and safe multi-car elevator shaft system where one elevator car with doors open too long cannot prevent the next car behind it from coming to the floor in a scheduled time. The solution also makes it possible to achieve a reliable and safe multi-car elevator shaft system where elevators cars can be moved safely though either the principal car door or landing door is stuck in an open position. Still one advantage is that the multi-car solution according to the invention increase the handling capacity per shaft, and therefore a building core space can be reduced more than, for example, with existing double-deck elevator solutions.

A suitable way to carry out the invention is that the door open time before starting the door closure is shortened. Also it is suitable to speeding up the closure time in this connection.

BRIEF DESCRIPTION OF THE DRAWINGS

In the following, the invention will be described in detail by the aid of examples of two multi-car elevator shaft systems by referring to the attached simplified and diagrammatic drawings, wherein.

DETAILED DESCRIPTION OF THE EMBODIMENTS

Figure 1:
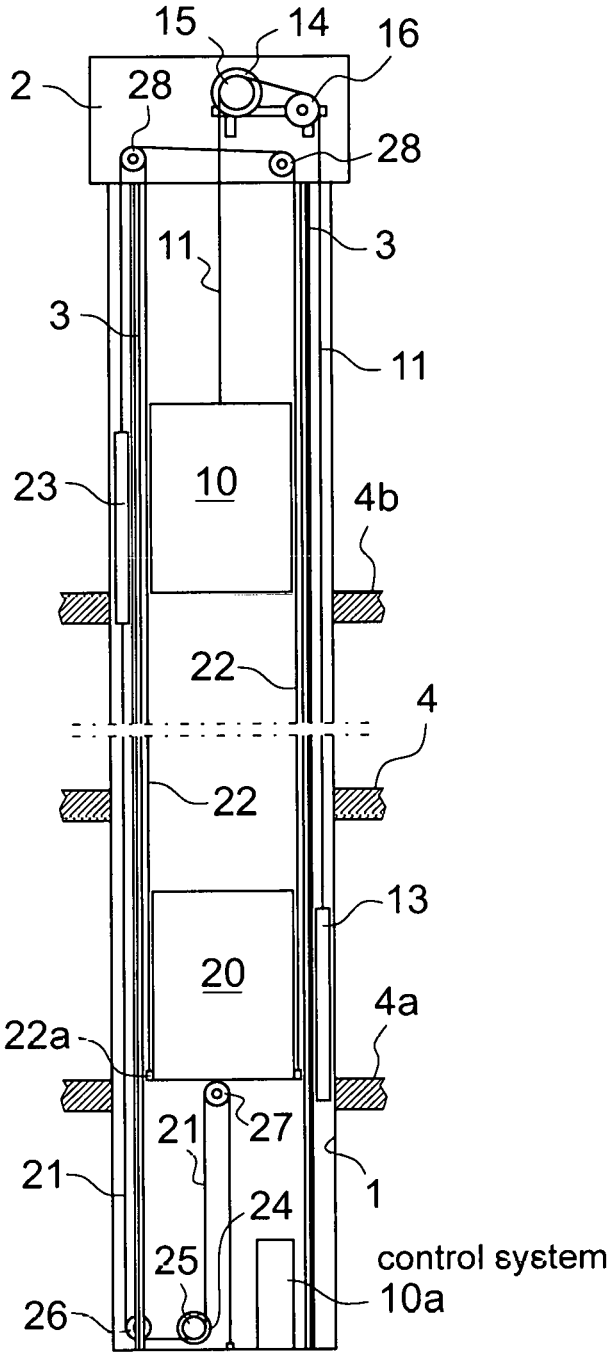
FIG. 1 presents in a simplified and diagrammatic front view a one-shaft elevator arrangement according to the invention with two elevator cars in the same shaft.

FIG. 1 presents in a simplified and diagrammatic front view one type of an elevator arrangement according to the invention with two elevator cars 10 and 20 running in the same elevator shaft 1. The first or the uppermost elevator car 10 is driven by a first hoisting machinery 14 equipped with a traction sheave 15 and a diverting pulley 16. In this example the hoisting machinery 14 is placed in a separate machine room 2 above the elevator shaft 1 but it could as well be placed also at the upper part of the elevator shaft 1, either on the wall of the elevator shaft 1 or at the guide rail 3 of the elevator cars 10, 20.

A hoisting rope 11 is installed between the first elevator car 10 and its counterweight 13 that can also be a compensating weight. The hoisting rope 11 in all embodiments of the invention can be a single rope or a bunch of similar parallel ropes. A first end of the hoisting rope 11 is secured at the upper part of the uppermost elevator car 10 and from the elevator car 10 the hoisting rope 11 is passed around and over the traction sheave 15 of the first hoisting machinery 14, and from the traction sheave 15 the hoisting rope 11 is further passed over the diverting pulley 16 to a first counterweight 13. The suspension ratio in the suspension like this is 1:1. The uppermost elevator car 10 is arranged to run through the whole elevator shaft 1 from the lowermost floor level 4*a* to the uppermost floor level 4*b* and vice versa.

The second or the lowermost elevator car 20 is driven by a second hoisting machinery 24 equipped with a drive wheel 25. In this example the second hoisting machinery 24 is placed in the lower part of the elevator shaft 1 below the second elevator car 20. First ends of the two suspension ropes 22 have been secured at the lower part of the lowermost elevator car 20 each end at its own side of the lowermost elevator car 20 where fastening points 22*a* are situated. From the fastening points 22*a* the suspension ropes 22 are passed around and over the diverting pulleys 28 that are placed in the machine room 2 or at the upper part of the elevator shaft 1 so high that the lowermost elevator car 20 can be landed at the uppermost floor level 4*b* of the elevator shaft 1. And finally from the diverting pulleys 28 the suspension ropes 22 are led to a second counterweight 23 that can also be a compensating weight.

The supporting and moving of the lowermost elevator car 20 are separated from each other. The arrangement comprises a separate traction member 21 that is connected between the second counterweight 23 and the second elevator car 20. The traction member 21 can be a single member or a bunch of similar parallel members, for instance the traction member 21 can be a toothed belt, chain or other type of member that does not slip on the drive wheel 25.

A first end of the traction member 21 is secured in its fastening point at the bottom of the elevator shaft 1 or at another appropriate place at the lower part of the elevator shaft 1. From the first end fastening point the traction member 21 is passed around and over the diverting pulley 27 that is placed at the lower part of the elevator car 20 and from the diverting pulley 27 the traction member 21 is passed under the drive sheave 25 of the second hoisting machinery 24, and from the drive sheave 25 the traction member 21 is further passed under a diverting pulley 26 to the second counterweight 23 where a second end of the traction member 21 is secured to the second counterweight 23. The suspension ratio in the suspension like this is 2:1. The lowermost elevator car 20 is also arranged to run through the whole elevator shaft 1 from the lowermost floor level 4*a* to the uppermost floor level 4*b* and vice versa.

In the arrangement according to FIG. 1 both the elevator cars 10, 20 are running along the same guide rails 3. The control system 10*a* of the elevator system has been arranged so that the elevator cars 10, 20 can move freely in the elevator shaft 1 without colliding each other. Thus, the elevator cars 10 and 20 can move simultaneously towards each other, away from each other, to the same direction, or the uppermost car 10 can move when the lowermost car 20 is stopped on the landing floor 4, 4*a* or 4*b*, or vice versa.

Figure 2:
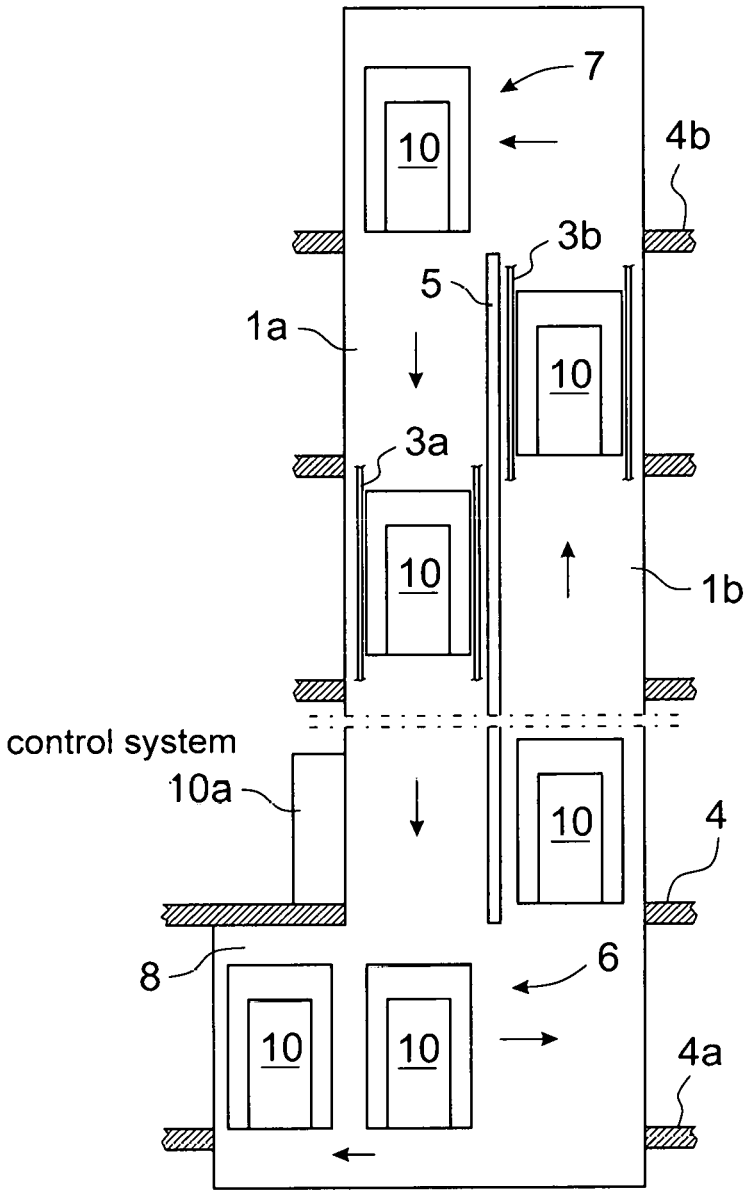
FIG. 2 presents in a simplified and diagrammatic front view a two-shaft elevator arrangement according to the invention with two or more elevator cars in the first elevator shaft moving downwards and two or more elevator cars in the second elevator shaft moving upwards.

FIG. 2 presents in a simplified and diagrammatic front view a two-shaft elevator arrangement according to the invention with two or more elevator cars 10 in the first elevator shaft 1*a* moving downwards and two or more elevator cars 10 in the second elevator shaft 1*b* moving upwards. This kind of multi-car elevator shaft system can be used, for instance, in normal high-rise buildings to replace elevator groups serving multiple floors.

All the elevator cars 10 are arranged to move independently from each other always in the same direction in one shaft 1*a*, 1*b*. The elevator cars 10 are self-propelled or moved by a special hoisting machinery. For the sake of clarity elevator hoisting machineries and roping system are not presented in FIG. 2, and the guide rails 3*a* and 3*b* are presented only partially. The two shafts 1*a* and 1*b* are separated from each other with a separating wall 5 that has a first opening 6 at the lowermost part of the separating wall 5 and a second opening 7 at the uppermost part of the separating wall 5. The openings 6 and 7 are used to move the elevator cars 10 horizontally from the first shaft 1*a* to the second shaft 1*b*, and vice versa. For the horizontal motion of the cars 10 the elevator arrangement is equipped with additional transfers machineries and horizontal guide rails or corresponding means. However, for the sake of clarity these additional elements are not presented in FIG. 2.

The elevator arrangement according to the invention comprises also a maintenance or fixing space 8 of the elevator cars 10. In case of a failure, for example a door failure, the inoperative elevator car 10 is moved to the maintenance space 8 in order to get it away from blocking the running of other elevator cars 10, and to rescue possible passengers from the elevator car 10. The maintenance space 8 is at a side of the first elevator shaft 1*a* at the bottom level of the shaft or at the lowermost floor level 4*a*. Special horizontal guide rails are arranged to guide the elevator car 10 to the maintenance space 8. As well maintenance space 8 could be situated at a side of each shaft 1*a* or 1*b* and at any height or at any floor level, or even in a space between the two shaft 1*a* and 1*b*.

In multi-car elevator shafts the elevators cars ahead of another cars can slow down the whole elevator system if they stop at a floor level 4, 4*a*, 4*b* for too long a time. For that reason the door open times should have quite a short limit for keeping doors open at a floor. A suitable time period is, for example, 10-30 seconds depending on the floor. On the entrance floor longer door open times are acceptable as possibly large amount of passengers enter and exit a car, but on upper floors only short door open times are allowed. A typical stop times or door open times could be learned by the elevator control system 10*a*.

The elevator arrangement according to the invention comprises means for monitoring door open times and in case the pre-defined time limit for the open time has passed the monitoring means are arranged to send orders to close the open door as fast as possible. In addition the elevator arrangement has means for warning passengers about the closing door, for example with a nudging sound, such as in metro or underground systems. Instead of the nudging sound another type of a warning and information message can also be given to the passengers.

For situations when the normal landing door 17*a* or car door 9*a* does not close when the accelerated door closing is activated, the elevator arrangement according to the invention is equipped with additional doors or door-like elements that are explained below in connection with FIG. 3.

Figure 3:
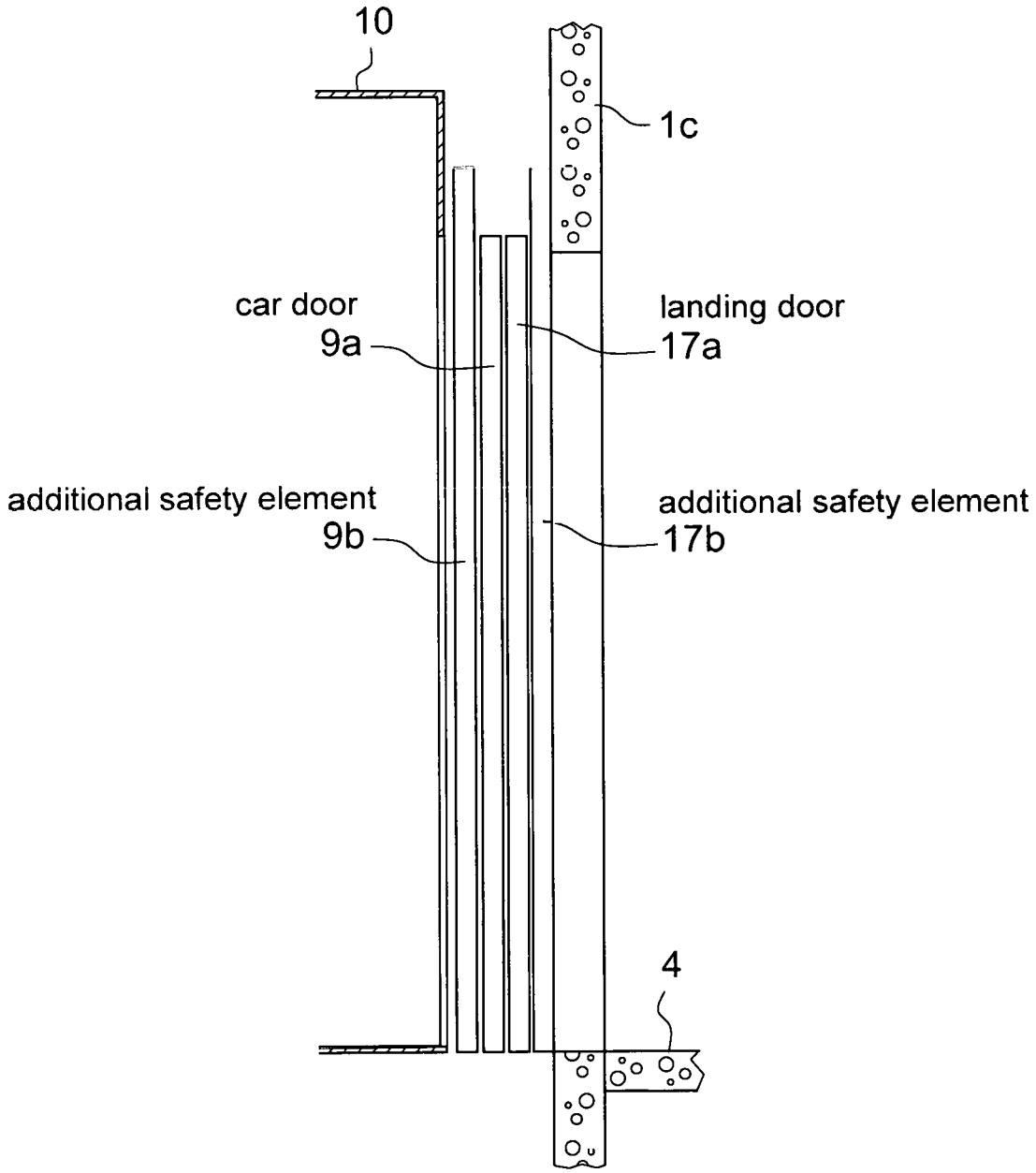
FIG. 3 presents in a simplified and diagrammatic side view a front part of an elevator car with elevator doors according to the invention at a landing floor.

FIG. 3 presents in a simplified and diagrammatic side view a part of an elevator car 10 with elevator doors according to the invention on a landing floor 4. Each elevator car 10 has a substantially normal car door 9*a* and an additional safety door 9*b* that is arranged to close the car doorway if the normal car door 9*a* fails to close. In this case the safety door 9*b* are closer to the elevator car 10 than the normal door 9*a* but they could be situated also vice versa.

In addition the elevator arrangement according to the invention has substantially normal landing doors 17*a* at each floor level 4, 4*a*, 4*b*, and an additional safety landing door 17*b* that is arranged to close the landing doorway if the normal landing door 17*a* fails to close. In this case the safety door 17*b* are closer to the wall 1*c* of the elevator shaft than the normal landing door 17*a* but they could be situated also vice versa. The safety doors 9*b* and 17*b* that act as additional safety elements can also be like grid walls and they can be moved either horizontally or vertically.

In case the normal landing door 17*a* does not close, the additional safety landing door 17*b* closes with a nudging sound and the car door 9*a* closes independently. After that the elevator car 10 can move forward, away from the cars coming behind, and the landing doorway at the floor level is safe thanks to the safety landing door 17*b*.

The arrangement according to the invention comprises means for detecting passengers inside the stopped car, and means for moving the car 10 with the additional safety door 9*b* in a closed position. In case of a failure in the car door 9*a*, so that the car door 9*a* does not close, and when there are passengers inside the car 10, the additional safety door 9*b* closes with a nudging sound, and the car 10 is moved to the maintenance space 8 for the rescue of the passengers and for the door maintenance.

Though the method and arrangement has been described above in a multi-car elevator shaft system the invention can also be used in normal one-car elevator shaft systems, and instead of using only in exceptional situations the method and arrangement according to the invention can also be used in normal situations to speed up the closing of the doors and thereby to improve the transportation capacity of the elevator. In that case the speeding up is done according to the traffic situation controlled by the control system 10*a* of the elevator and the speeding up is informed to the passengers, for example with a nudging sound. In that case the safety doors 9*b* and 17*b* are not used at all but the normal doors 9*a* and 17*a* are speeded up when needed.

The control system 10*a* of the elevator has also means for receiving special car calls or calls from landing floors. These calls can be for instance so-called handicap calls for wheelchair passengers. After receiving a call like that the speeding up of the door closing is not activated.

It is obvious to the person skilled in the art that the invention is not restricted to the example described above but that it may be varied within the scope of the claims presented below.

The invention claimed is:

1. A method for closing doors of an elevator that includes at least an elevator shaft, a plurality of cars each of which is configured to run along guide rails in the elevator shaft and is equipped with a car door, a plurality of landing doors that includes a landing door at each of a plurality of landings, a hoisting machinery, a roping system, shaft equipment, and a control system configured to control activities of the elevator and adjust door open times of one or more of the car doors of the plurality of cars and one or more of the landing doors, the method comprising:

monitoring and analyzing a door open time of a car door of a first car, from among the plurality of cars, the first car being a car stopped at a landing ahead of one or more other cars from among the plurality of cars; and, if a duration of the door open time will result in a stopped state of the first car interrupting a motion of at least a next car behind the first car, accelerating closure of the car door of the first car, and generating a sound to inform passengers of the accelerated closure at substantially the same time as the accelerated closure, wherein, when a door failure in which the car door of the first car does not close occurs, and there is at least one passenger detected in the first car, a car door opening of the first car is closed with a safety element after which the first car is moved away from the landing at which the first car was stopped.

2. The method for closing doors of an elevator according to claim 1, wherein, if the first car experiences the door failure and at least one other car, from among the plurality of cars, is operating in the elevator shaft, the first car is moved to a maintenance or fixing space in connection with the elevator shaft.

3. The method for closing doors of an elevator according to claim 1, wherein the accelerating the closure of the car door of the first car includes shortening a door open time before starting the closure of the car door of the first car.

4. An arrangement for closing doors of an elevator that comprises:

at least an elevator shaft;

a plurality of cars, each of which is configured to run along guide rails in the elevator shaft, and equipped with a car door;

a plurality of landing doors, the plurality of landing doors including a landing door at each of a plurality of landings;

a hoisting machinery;

a roping system;

shaft equipment; and a control system configured to, control the activities of the elevator, monitor and analyze a door open time of a car door of a first car, from among the plurality of cars, the first car being a car stopped at a landing ahead of one or more other cars from among the plurality of cars, and if a duration of the door open time will result in a stopped state of the first car interrupting a motion of at least a next car behind the first car, accelerate closure of the car door of the first car, and generate a sound to inform passengers of the accelerated closure, wherein the arrangement further includes a safety element, and wherein the control system is further configured to, detect passengers inside the stopped first car, and when a door failure in which the car door of the first car does not close occurs, and at least one passenger is detected in the first car, close a car door opening of the first car with the safety element, and move the first car away from the landing at which the first car was stopped, after closing the car door opening of the first car with the safety element.

5. The arrangement of claim 4, wherein the arrangement further comprises:

an alarm configured to inform passengers of the accelerated closure of the car door of the first car at substantially the same time as the accelerated closure.

6. The arrangement of claim 4 above, wherein the arrangement further comprises:

a maintenance or fixing space for maintenance and repair of the plurality of cars and for rescuing passengers if a door failure where a car door of a car, from among the plurality of cars, fails to close occurs.

* * * * *